US005622613A

United States Patent [19]

Arimoto et al.

[11] Patent Number: 5,622,613

[45] Date of Patent: Apr. 22, 1997

[54] ELECTROLYTIC METHOD FOR MANUFACTURING HYPOCHLORITE

[75] Inventors: Osamu Arimoto; Takamichi Kishi, both of Okayama, Japan

[73] Assignee: Chlorine Engineers Corp., Ltd., Tokyo, Japan

[21] Appl. No.: 538,655

[22] Filed: Oct. 4, 1995

[30] Foreign Application Priority Data

Oct. 5, 1994 [JP] Japan ..... 6-241085

[51] Int. Cl.[6] ..... C25B 1/26; C25B 1/22

[52] U.S. Cl. ..... 205/500; 205/464

[58] Field of Search ..... 205/464, 473, 205/474, 500, 300; 204/290 R

[56] References Cited

U.S. PATENT DOCUMENTS 4,443,317 4/1984 Kawashima et al. ..... 204/290 F 4,495,048 1/1985 Murakami et al. ..... 204/267

4,618,404 10/1986 Pellegri et al. ..... 204/128

5,248,401 9/1993 Bridger et al. ..... 204/290 R 5,336,384 8/1994 Tsou et al. ..... 204/252

*Primary Examiner*—John Niebling

*Assistant Examiner*—Alex Noguerola

*Attorney, Agent, or Firm*—Kuhn and Muller

[57] ABSTRACT

The present invention provides a method for manufacturing hypochlorite efficiently, using an anode, which has a coating containing palladium oxide by 10 to 45 weight %, ruthenium oxide by 15 to 45 weight %, titanium dioxide by 10 to 40 weight %, and platinum by 10 to 20 weight % as well as an oxide of at least one metal selected from cobalt, lanthanum, cerium or yttrium by 2 to 10 weight % being formed on a conductive base, and a cathode comprising a coating having low hydrogen overvoltage and covered with a reduction preventive film and being formed on a conductive base, and an aqueous solution of a chloride is electrolyzed without a diaphragm.

2 Claims, No Drawings

ELECTROLYTIC METHOD FOR MANUFACTURING HYPOCHLORITE

BACKGROUND OF THE INVENTION

The present invention relates to a method for manufacturing hypochlorite by electrolyzing brine, and in particular to a method for manufacturing a hypochlorite with available chlorine concentration of 3 to 7 weight % in efficient manner.

The technique to manufacture hypochlorite by electrolyzing brine is widely known in the art. Conventionally, when hypochlorite is manufactured through electrolysis of brine, available chlorine concentration of the hypochlorite thus obtained is mostly as low as 1 weight % or less, while a method to obtain a high concentration hypochlorite having available chlorine concentration of 3 weight % or more through electrolysis is disclosed in JP-A 63-143277. This method is carried out as follows: An aqueous solution with sodium chloride concentration of 10 weight % is electrolyzed without a diaphragm using an anode having a coating of platinum, palladium oxide, ruthenium dioxide and titanium dioxide and a cathode of titanium having area ratio of 1:1.4 to 1:40 to the anode under temperature of 10° to 22° C. and anode current density of 10 to 20 A/dm$^2$. In this method, titanium having high hydrogen overvoltage is used as cathode, and the cathode has an area smaller than that of the anode to suppress the reduction of hypochlorite ions at the cathode. In this connection, it is disadvantageous in that the current density at cathode is high and cathode voltage is high, thus leading to unfavorable electric power consumption rate. Further, it is also disadvantageous in that oxidizing efficiency of chloride ions by the membrane used as the anode is lower in the regions of high concentration hypochlorite ions.

It is an object of the present invention to provide a method, by which it is possible to solve the problems that electric power consumption rate is low in the manufacture of high concentration hypochlorite by electrolysis as practiced in the past and to manufacture high concentration hypochlorite through electrolysis at low voltage and at high current efficiency.

SUMMARY OF THE INVENTION

According to the method for manufacturing hypochlorite of the present invention, there are provided an anode, which has a coating containing palladium oxide by 10 to 45 weight %, ruthenium oxide by 15 to 45 weight %, titanium dioxide by 10 to 40 weight %, and platinum by 10 to 20 weight % as well as an oxide of at least one metal selected from cobalt, lanthanum, cerium or yttrium by 2 to 10 weight % being formed on a conductive base, and a cathode comprising a coating having low hydrogen overvoltage and covered with a reduction preventive film and being formed on a conductive base, whereby aqueous solution of a halide is electrolyzed without a diaphragm, and the reduction preventive film contains at least one selected from an organic cation exchanger or an inorganic cation exchanger.

DESCRIPTION OF THE PREFERRED EMBODIMENTS

According to the present invention, an anode having high activity to oxidize chloride ions and a cathode having low hydrogen overvoltage and covered with a film to suppress reduction of hypochlorite ions are provided, and aqueous solution of chloride such as brine is electrolyzed.

The anode used in the present invention comprises an electrode active film on a conductive base, and the coating contains palladium oxide by 10 to 45 weight %, ruthenium oxide by 15 to 45 weight %, titanium oxide by 10 to 40 weight %, and platinum by 10 to 20 weight % as well as an oxide of at least one metal selected from cobalt, lanthanum, cerium and yttrium by 2 to 10 weight %.

If the ratio of the oxide of at least one of cobalt, lanthanum, cerium, or yttrium is less than 2 weight % or more than 10 weight %, it is not desirable because oxidizing efficiency of halide ions is decreased in case decomposing ratio of the raw material halide is high or hypochlorite ion concentration is 4 weight % or more.

In case two or more oxides of cobalt, lanthanum, cerium or yttrium are used, the ratio of the total oxides should be within the above range.

To manufacture the anode of the present invention, a slurry-like coating solution containing a solution comprising solid component of oxides and metal components is coated, and after this is dried, it is burnt in an atmosphere containing oxygen. The solid component of the slurry-like coating solution contains an oxide of palladium and an oxide of at least one metal selected from cobalt, lanthanum, cerium or yttrium, and it is preferable to dissolve metal component such as ruthenium chloride, chloroplatinic acid, butoxytitanium, etc. in an organic solvent to use as solution component. As the organic solvent, butanol may be used. By preparing this as a slurry-like coating solution, it is possible to obtain an anode having excellent electrolyzing property, while the oxide added as solid component to the slurry-like coating solution does not adversely affect generation of electrode active coating.

In the anode of the present invention, an electrode base is pre-treated for surface toughening by sand-blast or by etching using acid treatment, and it is then washed with water and dried, and the slurry-like coating solution is coated on it. To coat, brushes, rollers, etc. may be used. The base with the coating solution coated on it is dried at room temperature and is further heated in an electric furnace.

The coating, drying and heating and burning processes of the slurry-like coating solution are repeated by 5 to 10 times to form a film of a given thickness. Burning is carried out in an atmosphere containing oxygen in an electric furnace at 400° to 600° C. for 5 to 30 minutes.

If the times of coating of the slurry-like coating solution on the electrode base are not many, overvoltage increases and anode activity is low. If the times of coating are too many, overvoltage is not decreased or anode activity is not improved to match the times of coating. Thus, it is preferable to coat by 5 to 10 times.

In the electrode active coating of the anode thus prepared, the oxide of metal such as palladium, cobalt, lanthanum, cerium, yttrium, etc., which are solid components in the slurry-like coating solution, is fixed in a porous mixed matrix of ruthenium oxide, titanium oxide and platinum. Because the solid component of the slurry-like coating solution gives no influence on crystal structure of the porous mixed matrix, a film having high mechanical strength can be obtained.

As the base of the anode of the present invention, thin film forming metal such as titanium, tantalum, etc. may be used, while it is most preferable to use titanium.

The base of the anode may be designed in any shape including rod-like shape, cylindrical or planar shape, or in shape of expanded metal, perforated plate or bamboo blind.

The cathode used in the present invention is prepared by applying a coating with low hydrogen overvoltage on an electrode base. As the coating having low hydrogen overvoltage, a coating containing precious metal, precious metal oxide or precious metal and titanium oxide or a coating containing precious metal oxide and titanium oxide may be used. To apply the coating having low hydrogen overvoltage on the electrode base, electroplating method, burning method, or metalization method may be used.

The base for the cathode may be designed in any shape including rod-like shape, cylindrical or planar shape or in shape of expanded metal, perforated plate, bamboo blind, etc.

As the base of the cathode used in the present invention, titanium, tantalum, nickel, stainless steel, etc. may be used, while it is most preferable to use titanium, which has high corrosion-resistant property to hypochlorite.

Further, in the cathode used in the present invention, a reduction preventive film is applied on the coating with low hydrogen overvoltage. Reduction prevention means that the reduction of hypochlorite ions by cathode is prevented. As the reduction preventive film, at least one selected from an organic cation exchanger, an inorganic cation exchanger, or a mixture of these substances may be used.

As the organic cation exchanger, fluororesin ion exchanger having exchange group of sulfonic acid or carboxylic acid may be used, and a solution, solid powder or dispersion of these substances may be used.

As the examples of the inorganic cation exchanger, an oxide hydrate of iron, manganese, titanium, zirconium or cerium, or a compound such as titanium phosphate, zirconium phosphate, zirconium molybdate, zeolite, etc. may be used.

In the present invention, the cation exchanger can be coated on the active coating of the cathode by preparing slurry or solution of the cation exchanger and by coating it on the cathode and drying it.

As the cation exchanger in the present invention, a cation exchanger may be used, which has cation exchanger property at the time of use but may not show cation exchanger property at the time of coating. For example, in case of fluororesin cation exchanger, a resin with sulfonylfluoride group or carboxylic acid methyl ester group bonded to it can be obtained in polymerization. In case such a substance is used as the coating solution, it is dried and hydrolyzed prior to electrolysis.

The solution of the cation exchanger can be produced by dissolving the organic cation exchanger in a solvent. To prepare the slurry of the cation exchanger, fine powder of organic cation exchanger or inorganic cation exchanger is attached on the surface of the cathode and is dispersed in matrix. As the matrix, synthetic resin or organic cation exchanger having no ion exchanger property may be used.

To form the cation exchanger on the surface of the cathode, a coating solution comprising a solution of cation exchanger or slurry of cation exchanger is coated using brushes, rollers, etc., or it is sprayed, or the cathode may be immersed in the coating solution. In case of the coating solution prepared by turning the cation exchanger to slurry state, it is preferable to mix the slurry in a stirring equipment such as ultrasonic disperser, shaker, or ball mill and to uniformly disperse the cation exchanger and to coat it.

The cathode coated with the coating solution is dried, and the cation exchanger forms a film fixed on the matrix. The cathode may be dried under any conditions including increased pressure, atmospheric pressure or reduced pressure. When it is dried by heating, heating furnace, hot air blowing or infrared irradiation, etc. may be used.

The coating quantity of the cation exchanger on cathode surface varies according to the type of cation exchanger, porosity of the coating substance, or concentration of cation exchanger in the coating solution. It is preferable to coat in such manner that the cation exchanger on cathode surface is 1.0 meq/m$^2$ or more. In case the cation exchanger on cathode surface is less than 10 meq/m$^2$, suppression of reduction of hypochlorite ions at the cathode is not sufficient, and this is not desirable.

The cation exchanger concentration in the coating solution is preferably 0.01% to 10%, or more preferably 0.05% to 5%. In case cation exchanger concentration in the coating solution is less than 0.01%, coating must be carried out by 10 times or more until as much cation exchanger as required can be coated, and much time is needed for the formation of the reduction preventive film, and this is not desirable. In case cation exchanger concentration in the coating solution is more than 10%, much more cation exchangers than required are attached by a single application or uniform coating is difficult to achieve because viscosity of the coating solution is increased, or large cracks occur on the film and reduction suppression effect is decreased.

In case the cation exchanger is turned to slurry and is used as the coating solution, particle size of the cation exchanger is preferably 0.01 to 10 μm. In case particle size of the cation exchanger is less than 0.01 μm, cation exchanger particles tend to aggregate, and it is difficult to disperse them separately. In case cation exchanger particle size is more than 10 μm, cation exchanger may be attached only sparsely on cathode surface, and the strength of the film is weakened and the film is easily peeled off from the cathode surface.

In the method for manufacturing hypochlorite of the present invention, the anode and the cathode prepared as described above are used, and aqueous solution of brine is electrolyzed without a diaphragm, and aqueous solution of hypochlorite is produced. There is no special restriction on the type of electrolytic cell, and an electrolytic cell of any shape including filter press type, box type, cylinder type, etc. may be used, or unipolar type or bipolar type may be used. Hypochlorite may be taken out by batch system or on continuous basis. Electrolysis may be performed with a single electrolytic cell or a number of electrolytic cells may be arranged and an electrolyte containing the hypochlorite obtained in the electrolytic cell may be supplied to the electrolytic cell of the next stage for further electrolysis.

The concentration of the brine used as material for electrolysis is preferably determined according to the concentration of the sodium hypochlorite to be produced. In case sodium hypochlorite with available chlorine concentration of 3% is to be produced, salt concentration is 6% or more. In case available chlorine concentration is 7% or more, salt concentration is 15% or more.

Current density is preferably 1 to 100 A/dm$^2$, or more preferably 5 to 50 A/dm$^2$. If current density is high, current efficiency is increased, while electrolytic voltage is also increased. Thus, it is preferable to select optimal current density by taking the scale of installation, electric power cost, etc. into account.

The temperature for electrolysis is preferably 0° to 40° C., or more preferably 5° to 20° C. With the increase of electrolysis temperature, electrolytic voltage is decreased, and current efficiency is also decreased at the same time. In case electrolysis temperature is too low, chlorine hydrate is deposited on anode surface, and this leads to decreased current efficiency or shorter service life of the anode. Therefore, optimal electrolysis temperature should be selected by taking electric power consumption rate, service life of anode, etc. into account.

In the present invention, a film comprising oxides of palladium, ruthenium, or titanium having high oxidizing efficiency of chloride and an oxide of at least one of platinum, cobalt, lanthanum, cerium or yttrium is formed on an electrode base as electrode active substance, and this is used as an anode, and a film comprising a cation exchanger and having reduction suppression effect is formed together with a coating with low hydrogen overvoltage is formed. Thus, it is possible to suppress reduction of oxidizing substance on cathode surface. Even when salt decomposition rate is increased, current efficiency is decreased relatively less, and a sodium hypochlorite solution having high concentration can be obtained.

In the following, detailed description will be given on embodiments of the present invention.

(Preparation of Anodes)

The anodes used in Examples and Comparative Examples of the present invention were prepared as follows:

A titanium plate of 5×5 cm was pre-treated for surface toughening by sand-blast and etching using oxalic acid. Then, a slurry was prepared, which contains an oxide of at least one selected from tricobalt tetraoxide, lanthanum oxide, cerium oxide, or yttrium oxide together with palladium oxide particles in a solution containing ruthenium chloride, tetra-n-butoxytitanium and chloroplatinic acid, and the slurry thus prepared was coated and dried and was burnt at 500° C. for 10 minutes under an air atmosphere in an electric furnace, and this procedure was repeated by four times. Further, it was coated once and dried and was burnt similarly for 30 minutes in an electric furnace. As a result, the anodes with specimen numbers 1 to 5 having films with the compositions shown in Table 1 were prepared. The anode with the specimen number 5 is used in Comparative Example, and it does not contain the oxide of a substance selected from tricobalt tetraoxide, lanthanum oxide, cerium oxide or yttrium oxide.

TABLE 1

| | Composition of anode film (weight %) | | | | | | | |
|---|---|---|---|---|---|---|---|---|
| Specimen No. | PdO | $RuO_2$ | $TiO_2$ | Pt | $Co_3O_4$ | $La_2O_3$ | $CeO_2$ | $Y_2O_3$ |
| 1 | 15.7 | 33.5 | 30.0 | 15.8 | 5.0 | | | |
| 2 | 38.5 | 20.2 | 16.4 | 16.4 | | 8.5 | | |
| 3 | 37.0 | 22.5 | 17.0 | 17.0 | | | 6.5 | |
| 4 | 38.3 | 20.0 | 16.5 | 16.5 | | | | 8.7 |
| 5 | 14.0 | 38.5 | 30.0 | 17.5 | | | | |

(Preparation of Cathodes)

The cathodes used in Examples and Comparative Examples were prepared as follows:

A titanium plate of 5×5 cm was pre-treated for surface toughening by sand-blast and etching with oxalic acid. Then, a solution containing tetra-n-butoxytitanium and chloroplatinic acid was prepared, and the solution thus prepared was coated and dried and was burnt at 500° C. for 10 minutes under an air atmosphere in an electric furnace, and this procedure was repeated by four times. Further, this was coated once and dried and was burnt for 30 minutes in an electric furnace, and the cathode with the specimen number 6 was prepared.

On the surface of a cathode prepared by the same procedure as the specimen number 6, a solution of fluororesin type cation exchanger [Aldrich Chemical; 5% sulfonic acid resin solution of Naphion (trade name of DuPont); equivalent weight 1100] was coated once without diluting, and this was dried in the air. Further, it was heated at 220° C. for 60 minutes in an electric furnace, and the cathode with the specimen number 7 was prepared. An inorganic ion exchanger prepared by the method described below was added to the solution of the fluororesin type cation exchanger solution and was dispersed, and this was used as the coating solution. This was coated, dried, and heated by the same procedure, and the cathodes with the specimen numbers 8 to 11 as shown in Table 2 were prepared.

Into 180 ml of 6N hydrochloric acid, 90 ml of titanium hydroxide: titanium tetrachloride (manufactured by Wako Pure Chemical Co.) was dissolved and this was diluted with 4.5 liters of water. Then, pH value was adjusted to 7 with 3N ammonia water and was left to stand overnight. After filtering, this was washed until no sign of ammonium ions was noticeable when precipitated with 0.01N hydrochloric acid. Then, it was rinsed with water until no sign of chloride ions was noticeable and was dried in the air.

After 90 g of zirconium: zirconium oxide (Wako Pure Chemical Co.) was heated together with concentrated sulfuric acid, this was dissolved in water and was precipitated with 6N ammonia water. After filtering, this was washed with 0.1N ammonia water to remove sulfuric acid ions. Further, it was dissolved in hydrochloric acid and 6N ammonia water was added once to adjust pH value to 7. After maturing overnight at 15° to 20° C., this was washed with water and was dried in the air.

After 100 g of cerium hydroxide: cerium oxide (Wako Pure Chemical Co.) was heated with concentrated sulfuric acid, it was dissolved. After diluting well, 6N ammonia water was added to adjust pH value to 11. After maturing overnight, it was rinsed with 0.1N ammonia water to remove chloride ions. Then, it was washed with water and was dried in the air.

Using ferric hydroxide: ferric chloride (Wako Pure Chemical Co.), 3 liters of 0.1 mol/l aqueous solution of was prepared. To this solution, 2.5% ammonia water was added, and this was heated at 70° C. and was left to stand for two days. The slurry thus prepared was filtered and was rinsed with 2.5% ammonia water until no sign of chloride ions was noticeable. Then, it was rinsed with water until no sign of ammonium ions was noticeable, and it was dried at 50° C..

TABLE 2

| | Q'ty of ion exchanger and additive | | |
|---|---|---|---|
| Specimen No. | Type of ion exchanger | Times of coating | Coating q'ty ($meq/m^2$) |
| 6 | None | 0 | 0 |

TABLE 2-continued

| Specimen No. | Q'ty of ion exchanger and additive: Type of ion exchanger | Times of coating | Coating q'ty (meq/m$^2$) |
|---|---|---|---|
| 7 | Perfluorosulfonic acid resin | 1 | 4.6 |
| 8 | Perfluorosulfonic acid resin | 1 | 4.6 |
| | Titanium hydroxide | | 0.4 |
| 9 | Perfluorosulfonic acid resin | 1 | 4.6 |
| | Zirconium hydroxide | | 0.4 |
| 10 | Perfluorosulfonic acid resin | 1 | 4.6 |
| | Cerium hydroxide | | 0.4 |
| 11 | Perfluorosulfonic acid resin | 1 | 4.6 |
| | Ferric hydroxide | | 0.4 |

(EXAMPLE 1)

On an electrolytic cell made of titanium (30×115×80 mm; W×D×H), the anode of the specimen No. 1 and the cathode of the specimen No. 7 were mounted. With anode-cathode distance of 2 mm, current density of 40 A/dm$^2$ based on anode area, and temperature 12° C., brine of 22% concentration was electrolyzed, and mean current efficiency and mean voltage were obtained when available chlorine concentration of the electrolytic solution was 4 weight %. The anode and the cathode used and the results are summarized in Table 3.

(EXAMPLES 2 TO 8 AND COMPARATIVE EXAMPLES 1 TO 5)

Using the anodes and the cathodes as given in Table 3, the results are shown in Table 3.

TABLE 3

| | Anode No. | Cathode No. or cathode material | Mean current efficiency (%) | Mean voltage (V) |
|---|---|---|---|---|
| Example 1 | 1 | 7 | 75 | 3.37 |
| Example 2 | 2 | 7 | 80 | 3.39 |
| Example 3 | 3 | 7 | 78 | 3.38 |
| Example 4 | 4 | 7 | 74 | 3.39 |
| Comparative Example 1 | 5 | 7 | 63 | 3.35 |
| Example 5 | 1 | 8 | 74 | 3.39 |
| Example 6 | 1 | 9 | 75 | 3.38 |

TABLE 3-continued

| | Anode No. | Cathode No. or cathode material | Mean current efficiency (%) | Mean voltage (V) |
|---|---|---|---|---|
| Example 7 | 1 | 10 | 77 | 3.39 |
| Example 8 | 1 | 11 | 72 | 3.38 |
| Comparative Example 2 | 1 | 6 | 62 | 3.36 |
| Comparative Example 3 | 1 | Titanium having an area of ⅕ of that of anode | 73 | 4.03 |
| Comparative Example 4 | 5 | Titanium having an area of ⅕ of that of anode | 70 | 4.01 |
| Comparative Example 5 | 5 | Titanium with the same area as the anode | 45 | 3.82 |

As described above, an anode having high oxidizing efficiency of chloride ions and a cathode having a coating with the effect to suppress reduction of hypochlorite ions were used together with an electrode coating with low hydrogen overvoltage. As a result, there is no need to reduce the area of the cathode to smaller than that of the anode. Thus, the decrease of electrolytic efficiency is prevented, and high concentration hypochlorite can be produced at low electric power consumption rate.

What we claim are:

1. A method for manufacturing hypochlorite, comprising an anode, which has a coating containing palladium oxide by 10 to 45 weight %, ruthenium oxide by 15 to 45 weight %, titanium dioxide by 10 to 40 weight %, and platinum by 10 to 20 weight % as well as an oxide of at least one metal selected from cobalt, lanthanum, cerium or yttrium by 2 to 10 weight % being formed on a conductive base, and a cathode comprising a coating having low hydrogen overvoltage and covered with a reduction preventive film and being formed on a conductive base, whereby an aqueous solution of a chloride is electrolyzed without a diaphragm.

2. A method for manufacturing hypochlorite according to claim 1, wherein the reduction preventive film contains at least one selected from an organic cation exchanger or an inorganic cation exchanger.

* * * * *